United States Patent [19]

Ricketts

[11] 4,372,615

[45] Feb. 8, 1983

[54] METHOD OF RUBBLING OIL SHALE

[75] Inventor: Thomas E. Ricketts, Grand Junction, Colo.

[73] Assignee: Occidental Oil Shale, Inc., Grand Junction, Colo.

[21] Appl. No.: 192,330

[22] Filed: Sep. 29, 1980

Related U.S. Application Data

[63] Continuation of Ser. No. 75,846, Sep. 14, 1979, abandoned.

[51] Int. Cl.[3] ..... E21C 41/10; E21B 43/263

[52] U.S. Cl. ..... 299/2; 299/13

[58] Field of Search ..... 299/2, 11, 19

[56] References Cited

U.S. PATENT DOCUMENTS

| | | | |
|---|---|---|---|
| 3,848,927 | 11/1974 | Livingstone | 299/13 |
| 3,917,346 | 11/1975 | Janssen | 299/13 |
| 4,043,598 | 8/1977 | French | 299/2 |
| 4,045,085 | 8/1977 | Garrett | 299/2 |
| 4,109,964 | 8/1978 | Ridley | 299/2 |
| 4,153,298 | 5/1979 | McCarthy | 299/2 |
| 4,194,789 | 3/1980 | Studebaker | 299/13 |

*Primary Examiner*—William F. Pate, III

*Attorney, Agent, or Firm*—Christi e, Parker & Hale

[57] ABSTRACT

This invention relates to a method of recovering shale oil from a subterranean formation containing oil shale. Unfragmented formation is explosively expanded in a single round of explosions for moving formation located at about the center of a zone of unfragmented formation a greater distance in a given time interval after the beginning of the round than formation located in the unfragmented formation outward from about the center of the unfragmented formation.

The explosive expansion forms a fragmented mass of formation particles containing oil shale in the subterranean formation forming an in situ oil shale retort.

Gas is introduced into the fragmented permeable mass in the in situ oil shale retort for establishing a retorting zone in the fragmented permeable mass wherein oil shale is retorted to produce gaseous and liquid products, and for advancing the retorting zone through the fragmented mass. Gaseous and liquid products are withdrawn from the bottom of the retort.

39 Claims, 9 Drawing Figures

18
18
70
34
34
18
42
42
44
44
42
42
20
12
15
14
14
72
16
74

METHOD OF RUBBLING OIL SHALE

CROSS REFERENCE TO RELATED APPLICATIONS

This is a continuation of application Ser. No. 075,846, filed Sept. 14, 1979, now abandoned.

BACKGROUND OF THE INVENTION

This invention relates to in situ recovery of shale oil and, more particularly, to techniques for explosive expansion of formation toward horizontal free faces within a retort site for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423, 4,043,595, 4,043,596, 4,043,597 and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooled oil shale fragments in the retort on the advancing side of the retorting zone. The liquid hydrocarbon products, together with water produced in or added to the retort, collect at the bottom of the retort and are withdrawn. An off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above another within the retort site. A plurality of vertically spaced apart zones of unfragmented formation are temporarily left between the voids. Explosive is placed in each of the unfragmented zones and detonated, preferably in a single round, to explosively expand each unfragmented zone into the voids to form a fragmented mass. Retorting of the fragmented mass is then carried out to recover shale oil from the oil shale.

U.S. patent application Ser. No. 929,250 titled "METHOD FOR EXPLOSIVE EXPANSION TOWARD HORIZONTAL FREE FACES FOR FORMING AN IN SITU OIL SHALE RETORT" filed July 31, 1978 now U.S. Pat. No. 4,192,554 by the applicant and assigned to the assignee of the present invention describes a method for forming an in situ oil shale retort by expanding formation toward vertically spaced apart voids. Patent application Ser. No. 929,250 is incorporated herein by reference.

U.S. patent application Ser. No. 833,240 filed Sept. 14, 1977 by Gordon B. French titled "PLACEMENT FOR EXPLOSIVE EXPANSION TOWARD SPACED APART VOIDS", now U.S. Pat. No. 4,146,272 which is assigned to the assignee of the present application, describes a method for forming an in situ oil shale retort by expanding formation into vertically spaced apart voids containing support pillars. The pillars are explosively expanded to spread the particles thereof uniformly across the void, and unfragmented formation adjacent the void is explosively expanded toward the void before overlying unsupported formation can cave into such void. Said U.S. patent application Ser. No. 833,240 is incorporated herein by reference.

U.S. patent application Ser. No. 075,810 titled "METHOD OF RUBBLING A PILLAR" filed Sept. 14, 1979 by the applicant and assigned to the assignee of the present invention describes a method of explosively expanding a generally rectangular support pillar toward a void. U.S. patent application Ser. No. 075,810 is incorporated herein by reference.

It is desirable to form an in situ retort with a generally uniformly distributed void fraction, or a fragmented mass of generally uniform permeability so that oxygen supplying gas can flow relatively uniformly through the fragmented mass during retorting operations. Techniques used for explosively expanding zones of unfragmented formation toward the horizontal free faces of ormation adjacent the voids can control the uniformity f particle size or permeability of the fragmented mass. A fragmented mass having generally uniform permeability in horizontal planes across the fragmented mass voids bypassing portions of the fragmented mass by etorting gas.

SUMMARY OF THE INVENTION

The present invention provides a method of recovering shale oil from a subterranean formation containing oil shale. Formation is excavated to form at least one void in the subterranean formation leaving zones of unfragmented formation above and below each void wherein each zone of unfragmented formation has a substantially horizontal free face adjoining the void. Explosive is placed into at least one of the zones of unfragmented formation. A fragmented permeable mass of formation particles containing oil shale is formed in the subterranean formation, forming an in situ oil shale retort, by explosively expanding the unfragmented formation in such a zone. The explosive expansion of unfragmented formation is in a single round of explosions for moving formation located at about the center of the zone of unfragmented formation a greater distance in a given time interval after the beginning of the round than formation located in the unfragmented formation outward from about the center of such unfragmented formation.

When at least one support pillar is left in a void, explosive is placed into such a pillar. Explosive is detonated in the pillar and in the unfragmented formation in a single round for moving formation located at about the center of such a zone of unfragmented formation a greater distance in a given time interval after the start of the round than formation located in the unfragmented formation outward from about the center of the unfragmented formation. The detonation of explosive thereby forms a fragmented mass of formation particles containing oil shale in the subterranean formation forming an in situ oil shale retort.

Gas is introduced into the fragmented permeable mass in the in situ oil shale retort for establishing a retorting zone in the fragmented permeable mass wherein oil shale is retorted to produce gaseous and liquid products, and for advancing the retorting zone through the fragmented mass. Gaseous and liquid products are withdrawn from the bottom of the retort.

DRAWINGS

These and other aspects of the invention will be more fully understood by referring to the following detailed description and the accompanying drawings in which.

DETAILED DESCRIPTION

Figure 1:
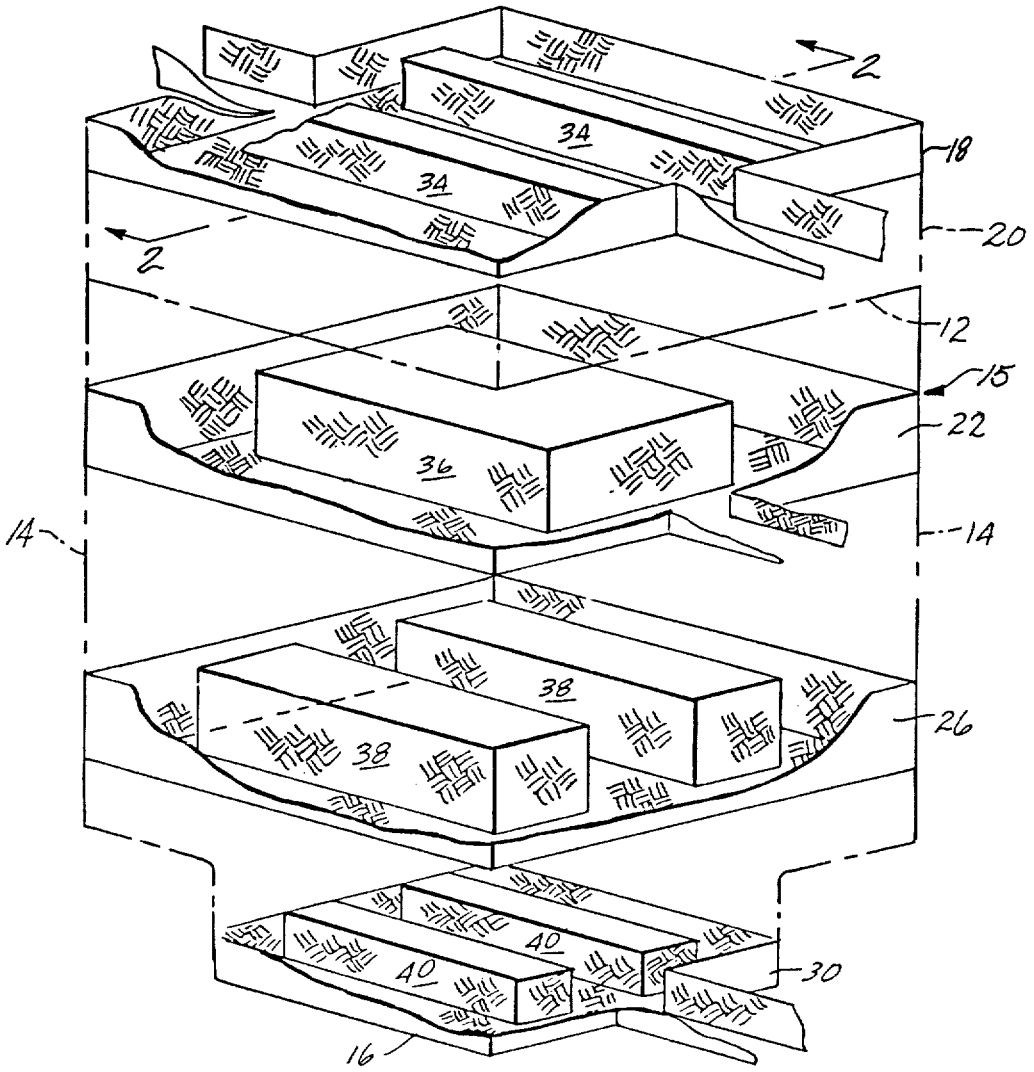
FIG. 1 is a fragmentary, semi-schematic perspective view showing a subterranean formation containing oil shale prepared for explosive expansion for forming an in situ oil shale retort.

This invention relates to a method of recovering shale oil from a subterranean formation containing oil shale. More particularly, this invention relates to a method for forming an in situ oil shale retort having a reasonably uniformly distributed fragmented permeable mass of formation particles.

One technique for forming an in situ oil shale retort involves excavating at least one horizontally extending void within a retort site and explosively expanding oil shale toward such a void. Oil shale can be expanded toward such a void from beneath its floor, in which case the floor is a horizontally extending free face for explosive expansion. Oil shale can be expanded toward such a void from above, in which case the roof of the void provides a horizontally extending free face. In addition, oil shale can be explosively expanded toward such a void from both above and below the void. If desired, a plurality of such voids vertically spaced apart from each other can be used for forming the in situ oil shale retort.

In some cases, the horizontal extent of the void is sufficiently large that an unsupported span of oil shale above the void can present a safety hazard. Under such circumstances, one or more roof supporting pillars of unfragmented oil shale can be temporarily left in the void. Such a pillar is explosively expanded before oil shale from above and/or below the void is explosively expanded. Preferably, explosive which is placed into the pillar and into the unfragmented formation of oil shale is detonated in a single round.

Detonation in a single round, as used herein, means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

In the process of explosively expanding oil shale toward horizontal free faces where support pillars are left in the void, the timing of removing the pillars and expanding the unfragmented formation from above and/or below the void is important.

The detonation of explosive charges in a pillar located in a void is preferably before the detonation of explosive in the unfragmented formation above and/or below such a void. Also preferably, there should be a sufficient time delay between the explosive expansion of the pillar and the explosive expansion of the zone or zones of unfragmented formation to enable a free face to form at the juncture of such a pillar and the zones of unfragmented formation to be explosively expanded. In addition, the time delay between explosive expansion of such a pillar and the explosive expansion of the zone of unfragmented formation above and/or below the void should allow pillar fragments to spread substantially uniformly across the void. It is preferred that the first explosive expansion of the unfragmented formation above and/or below the void is at a time when pillar fragments remain airborne. Thereafter, unfragmented formation above and/or below the void is explosively expanded and the pillar fragments are thereby dispersed among the oil shale particles created by the explosive expansion of the unfragmented formation. It is desirable to time the sequence of detonations in the unfragmented formation so that the fragments from the expansion of the pillars in a void are dispersed substantially uniformly in a horizontal plane across the fragmented permeable mass.

If, for example, the first explosive expansion of unfragmented formation is delayed too long, all of the pillar fragments can have travelled all of the way outwardly to the outer boundaries of the retort. This can leave little room for expansion of unfragmented formation from above and/or below the void in these outer areas, thereby resulting in zones of low void fraction in such areas.

If the explosive expansion of the unfragmented formation above and/or below the void is not delayed a sufficient time after the explosive expansion of a pillar, the pillar fragments can be trapped before they have a chance to spread uniformly across the retort. This can result in a zone or zones of low void fraction in the area formerly occupied by the pillar.

In practicing principles of this invention, an explosive expansion of unfragmented formation should be detonated in a manner such that formation located at about the center of such a zone of unfragmented formation moves a greater distance in a given time interval after the beginning of the round of explosive expansions than formation located in the unfragmented formation horizontally outward from about the center of such zone of unfragmented formation. As used herein, the term "center of the zone of unfragmented formation" means a locus of points in the unfragmented formation to be explosively expanded at about the center of an area defined by the boundaries of such void.

For example, where a support pillar is located substantially in the center of a void and is explosively expanded, more time is required for the pillar fragments to travel to the outer boundaries of the retort than is required for fragments to move only a short distance from the pillar. If the entire zone of unfragmented formation above the void were explosively expanded at the same time for moving formation the same distance during a given time period after the beginning of the round of explosions, then pillar fragments can be trapped before they move a sufficient distance toward the outer boundaries of the retort. When, however, the unfragmented formation from above and/or below the void near the center of the void is caused to move a greater distance during a given time period after the beginning of the round of explosions than formation near the outer boundary, the pillar fragments will have a chance to spread across the entire void. The movement of formation from above and/or below the void can spread pillar fragments substantially uniformly across the entire horizontal cross-section of the fragmented permeable mass being formed.

The formation which is at about the center of the zone of unfragmented formation can be caused to move a greater distance during a given time interval after the start of the round of explosions by several techniques.

For example, one technique used to move formation located at about the center of a zone of unfragmented formation a greater distance in a given time interval after the beginning of a round of explosions than formation located in the unfragmented formation outward from about the center of the zone of unfragmented formation is to vary the timing of the explosive expansion in the zone of unfragmented formation above and/or below the void. The timing can be varied, for example, to provide that the first detonation of explosive is at about the center of the zone of unfragmented formation followed by detonation of explosive in the zone of unfragmented formation progressing generally radially outwardly in a horizontal direction from the first detonation. When support pillars are left in the void, it can be desired that the first detonation of explosive in the zone of unfragmented formation above and/or below such pillars be at about the locus of the center of mass of such a pillar followed by detonation of explosive in the zone of unfragmented formation progressing generally radially outwardly from the first detonation.

In this technique, formation near the center of the zone of unfragmented formation will move a greater distance in a given time period after the initial expansion in a round of time delay explosions because the locus at about the center of mass of such formation has begun moving first. That is, since this portion of the formation is travelling the longest relative to other adjacent portions of the unfragmented formation, it will, for any given time period, travel the farthest distance.

To enable a better understanding of the principles of this invention, an example of the relative timing for expansion of pillars and unfragmented formation above and/or below a void is provided in the formation of the in situ oil shale retort of an exemplary embodiment.

Figure 2:
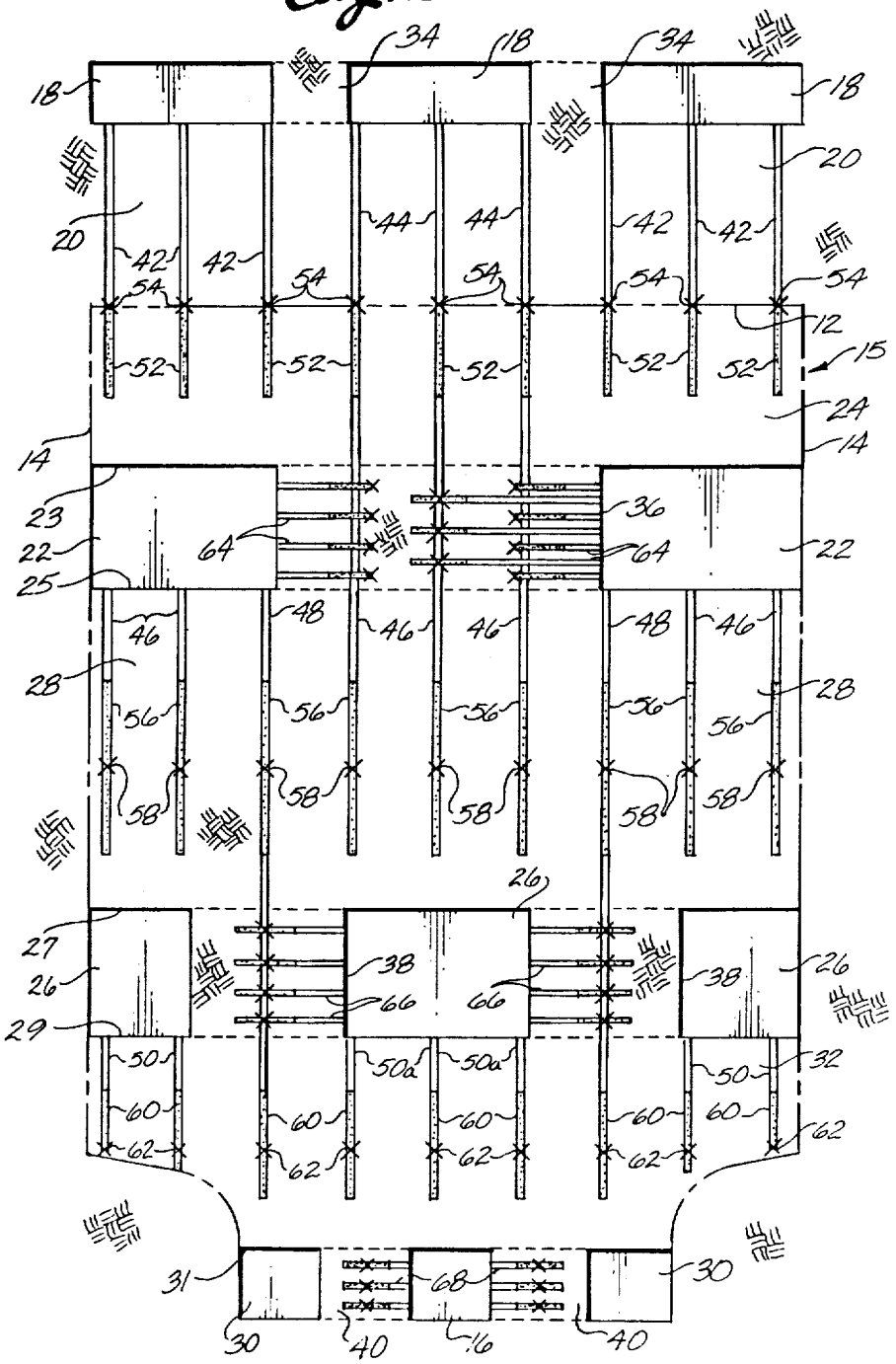
FIG. 2 is a fragmentary, semi-schematic vertical cross-sectional view taken on line 2—2 of FIG. 1.

In such an exemplary embodiment, FIGS. 1 and 2 schematically illustrate an in situ oil shale retort 15 being formed in accordance with principles of this invention. FIG. 1 is a semi-schematic, perspective view and FIG. 2 is a semi-schematic, vertical cross-section at one stage during preparation of an in situ retort. As illustrated in FIG. 2, the in situ retort is being formed in a subterranean formation 10 containing oil shale. The in situ retort shown in FIGS. 1 and 2 is rectangular in horizontal cross-section, having a top boundary 12, four vertically extending side boundaries 14, and a bottom boundary 16.

The in situ retort is formed by a horizontal free face system in which formation is excavated to form at least one void in the subterranean formation within the retort site wherein each such void extends horizontally across a different elevation of the retort site, leaving zones of unfragmented formation above and below each void. Each zone of unfragmented formation has a substantially horizontal free face adjoining such a void. For clarity of illustration, each horizontal void is illustrated in FIG. 1 as a rectangular box having an open top and a hollow interior. One or more pillars of unfragmented formation can be left within each void, if desired, for providing temporary roof support. The pillars are illustrated as rectangular boxes inside the voids illustrated in FIG. 1.

In the embodiment illustrated in FIGS. 1 and 2, a portion of the formation within the retort site is excavated on an upper working level for forming an open base of operation in an air level void 18. The floor of the base of operation is spaced above the top boundary 12 of the retort being formed, leaving a horizontal sill pillar 20 of unfragmented formation between the floor of the base of operation and the upper boundary of the retort being formed.

In the horizontal free face system illustrated in FIGS. 1 and 2, three vertically spaced apart horizontal voids are excavated within the retort site below the sill pillar 20. A rectangular upper void 22 is excavated at a level spaced vertically below the sill pillar, leaving an upper zone 24 of unfragmented formation extending horizontally across the retort site between the top boundary 12 of the retort being formed and a horizontal free face 23 above the upper void. A rectangular intermediate void 26 is excavated at an intermediate level of the retort being formed, leaving an intermediate zone 28 of unfragmented formation extending horizontally across the retort site between a horizontal free face 25 below the upper void and a horizontal free face 27 above the intermediate void.

A production level void 30 is excavated at a lower production level of the retort being formed, leaving a lower zone 32 of unfragmented formation extending horizontally across the retort site between a horizontal free face 29 below the intermediate void and a horizontal free face 31 above the production level void.

Support pillars can, if desired, be left within the horizontal voids for providing temporary roof support for the zone of unfragmented formation overlying each void. Each such support pillar comprises a column of unfragmented formation integral with and extending between the roof and the floor of each horizontal void. Formation can be excavated to provide pillars similar to islands in which all side walls of the pillars are spaced horizontally from corresponding side walls of formation adjacent the void; or formation can be excavated to provide pillars similar to peninsulas in which one end of the pillar is integral with a side wall of formation adjacent the void, while the remaining side wall or walls of the pillars are spaced horizontally from the corresponding side walls of formation adjacent the void.

As shown in FIG. 1, the air level void 18 illustratively includes a pair of laterally spaced apart, parallel, relatively long and narrow support pillars 34 where each pillar has first and second long faces which extend most of the length of the air level void and each pillar has an end in a plane substantially perpendicular to the long faces. Each pillar 34 is similar to a peninsula, with one end of such a pillar being integral with a side wall of formation adjacent the air level void, forming a generally E-shaped void space within the air level void.

The upper void 22 includes one large support pillar 36 of rectangular horizontal cross-section located centrally within the upper void. The pillar 36 is similar to an island, with all side walls of the pillar being spaced from corresponding side walls of formation adjacent the upper void, forming a generally rectangular peripheral void space surrounding all four side walls of the support pillar. The pillar 36 has first and second long free faces extending the length of the pillar and two ends in a plane substantially perpendicular to the long free faces.

The intermediate void 26 includes a pair of laterally spaced apart, parallel, relatively long and narrow support pillars 38. The support pillars in the intermediate void have first and second long free faces which extend a major part of the width of the void and two ends in a plane substantially perpendicular to the long free faces. These pillars are similar to islands in that a void space surrounds the entire periphery of each pillar.

As illustratively shown, the excavated volume of the upper void 22 is about the same as the excavated volume of the intermediate void 26 so that the substantially equal volume of formation which is to be expanded toward each such void has about the same volume into which to expand. This promotes uniformity of void fraction distribution.

The production level void 30 includes a pair of laterally spaced apart, relatively long and narrow, parallel support pillars 40 where each support pillar has a first and second long free face extending a major part of the width of the production level void and one end in a plane substantially perpendicular to the long free faces. The support pillars 40 are similar to peninsulas, forming a generally E-shaped void space within the lower void. The ends of the pillars in the lower void are integral with the rear wall of the lower void, as the retort is viewed in FIG. 1.

It should be noted that although support pillars are left in each of the voids excavated in the subterranean formation of the exemplary embodiment, voids can be excavated where no pillars remain in such voids The unfragmented formation can be prepared for explosive expansion by placing an array of explosive charges into at least one of the zones of unfragmented formation. The placement of explosive into the zones of unfragmented formation is accomplished in the exemplary embodiment by drilling vertical blastholes upwardly and/or downwardly in portions of the unfragmented formation within the boundaries of the retort site from an excavation adjacent such unfragmented formation. For example, FIG. 2 shows vertical blastholes 42 drilled into the upper zone 24 of unfragmented formation, blastholes 44 drilled through the upper zone 24 of unfragmented formation, through the pillar 36, and into the intermediate zone 28 of unfragmented formation, blastholes 46 drilled into the intermediate zone 28 of unfragmented formation, blastholes 48 drilled through the intermediate zone 28 of unfragmented formation, through a lower pillar 38, and into the lower zone 32 of unfragmented formation and blastholes 50 drilled into the lower zone 32 of unfragmented formation. The blastholes are shown out of proportion in FIG. 2, i.e., the diameter of the blastholes is actually much smaller in relation to the horizontal dimensions of the retort than shown in FIG. 2.

The blastholes can be loaded with explosive charges for explosive expansion of at least one of the zones of unfragmented formation above and/or below each void toward the void to form a fragmented mass of formation particles containing oil shale in the in situ oil shale retort.

In the exemplary embodiment, there are blastholes extending into the upper, intermediate, and production level zones of unfragmented formation for explosively expanding such zones of unfragmented formation toward each void. Explosive is loaded into each blasthole extending into the upper zone 24 of unfragmented formation for providing explosive charges 52 where the length of each column of explosive is about half the thickness of the upper zone of unfragmented formation. Although it has been found to be desirable to have the length of each column of explosive about half the thickness of the zone of unfragmented formation to be expanded, columns of explosive, either longer or shorter than about half the thickness of the zone of unfragmented formation to be expanded, can be used if desired. Detonators 54 indicated by an "x" are placed into each explosive charge 52 at a location in the explosive charge remote from the free face to which the unfragmented formation is to be blasted.

Blastholes in the intermediate zone are loaded with explosive for providing explosive charges 56 in the intermediate zone 28 of unfragmented formation where the length of each column of explosive 56 is about half the thickness of the intermediate zone of unfragmented formation. Detonators 58 are placed into each explosive charge 56 at a location in the explosive charge equidistant and, therefore, remote from the respective free faces above and below the intermediate zone of unfragmented formation. This placement of detonators 58 provides for explosive expansion of an upper portion of the intermediate zone of unfragmented formation toward the upper void 22 and for explosive expansion of a lower portion of the intermediate zone of unfragmented formation toward the intermediate void 26.

Blastholes in the lower zone 32 of unfragmented formation are loaded with explosive for providing explosive charges 60 in the lower zone of unfragmented formation for providing for explosive expansion of the lower zone of unfragmented formation to result in a substantially uniformly distributed fragmented permeable mass of formation particles. Detonators 62 are placed into each explosive charge in each blasthole for explosive expansion of the lower zone of unfragmented formation into both the intermediate void and the production level void.

Additional details of drilling vertical blastholes in unfragmented formation and placement of explosive charges and detonators into such blastholes are disclosed in patent application Ser. No. 929,250, the disclosure of which is incorporated by reference hereinabove.

Explosive is also placed into each support pillar in the upper, intermediate, and production level voids 22, 26, and 30, respectively, for providing explosive expansion of the pillars toward voids in which such pillars are located.

In the exemplary embodiment, the upper level support pillar 36 has decked charges for explosively expanding the pillar in stages. The outer portions of the upper level support pillar are explosively expanded first, followed by explosive expansion of the center portion of the pillar. All of the explosive placed into each of the intermediate void support pillars is detonated at about the same time. There is, therefore, only one explosive expansion of each of the intermediate level support pillars in the exemplary embodiment.

In the exemplary embodiment, the preparation of the formation for explosive expansion is completed by explosively expanding the pillars in the production level void toward the void. Thereafter, the explosive expansion of the pillars in the upper level void, intermediate void, and explosive expansion of the unfragmented formation from above and below the voids takes place in a single round of time delayed explosions. Other sequences of explosive expansions can be used if desired. For example, the pillars in the production level void can be explosively expanded at a time other than prior to explosive expansion of the pillars of the upper level and intermediate level void and the explosive expansion of the unfragmented formation.

To make clear the method used in the exemplary embodiment for the explosive expansion of unfragmented formation, time 0 is chosen to be after explosive expansion of the production level pillars and is selected as the time of initiation of the single round of explosive expansions of the larger pillars 36 and 38 and the horizontal zones of formation 24, 28, and 32 adjacent the horizontal voids. In the exemplary embodiment, the pillars in the production level void can be expanded in the same round or appreciably earlier than time 0.

FIGS. 4 through 8 show an exemplary sequence of explosive expansions for explosively expanding the pillars that were left in the upper void 22 and intermediate void 26 and for explosively expanding the surrounding zones of unfragmented formation 24, 28, and 32 during formation of the in situ oil shale retort.

Figure 4:
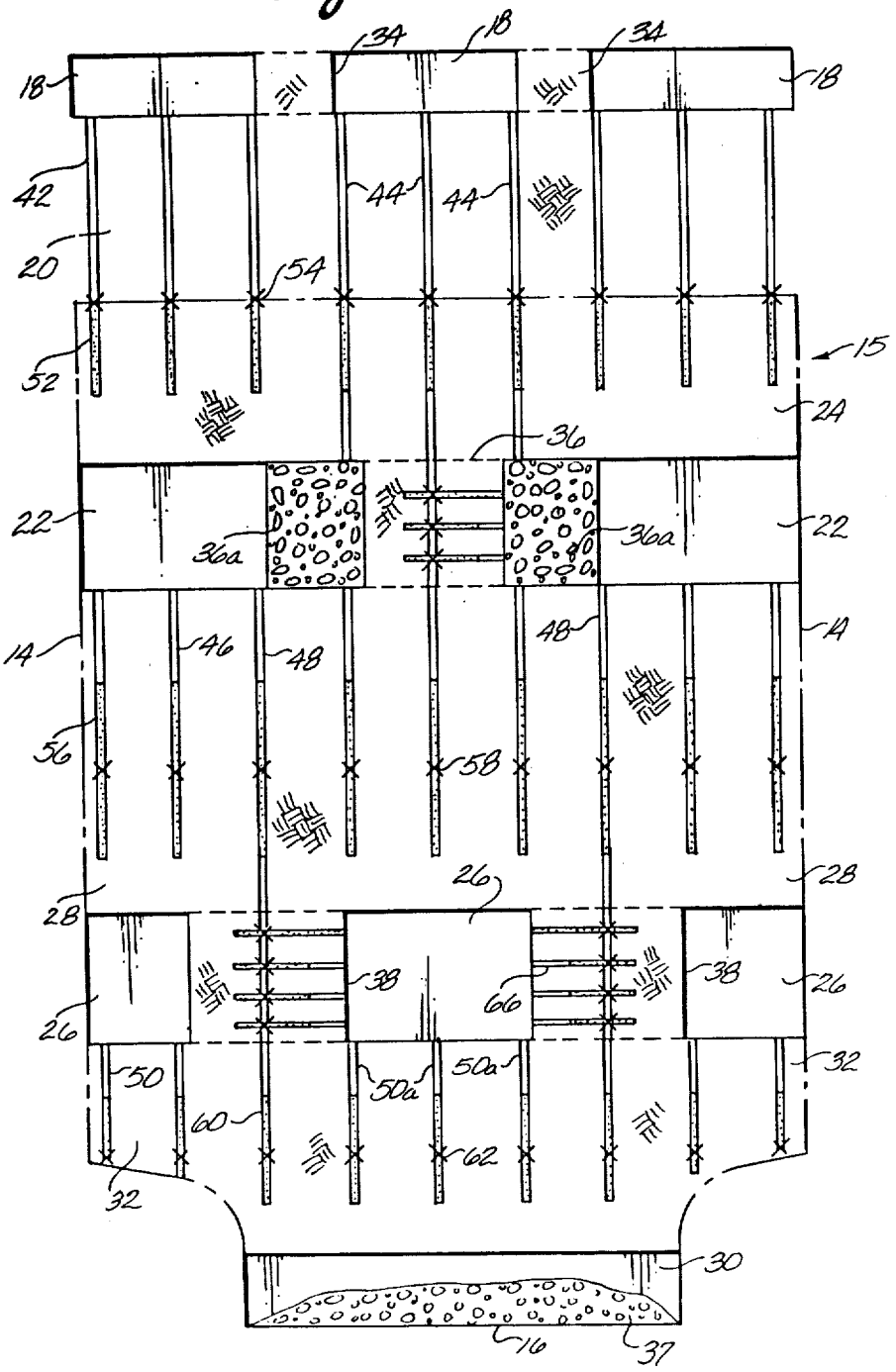
FIG. 4 is the same view as FIG. 2 at a first time interval after commencement of explosive expansion to form a fragmented mass of particles in the retort.

Referring to FIG. 4, the first explosive expansion in the single round of explosive expansions takes place with a time delay of about 25 milliseconds in the upper level pillar 36, i.e., the first explosive expansion takes place at time 25 milliseconds after time 0. The outer two rows of explosive in the horizontal blastholes 64 of the upper level pillar are detonated first, explosively expanding each side of the upper level pillar 36 as the first event of the single round of explosive expansions. At the instant illustrated, the fragments from the pillars in the production level void 30 are distributed in a heap 37 on the floor of the void. The outer portion of the upper level pillar 36 is fractured and commencing to explosively expand as indicated by the cross-sectional markings at **36*a***.

Figure 5:
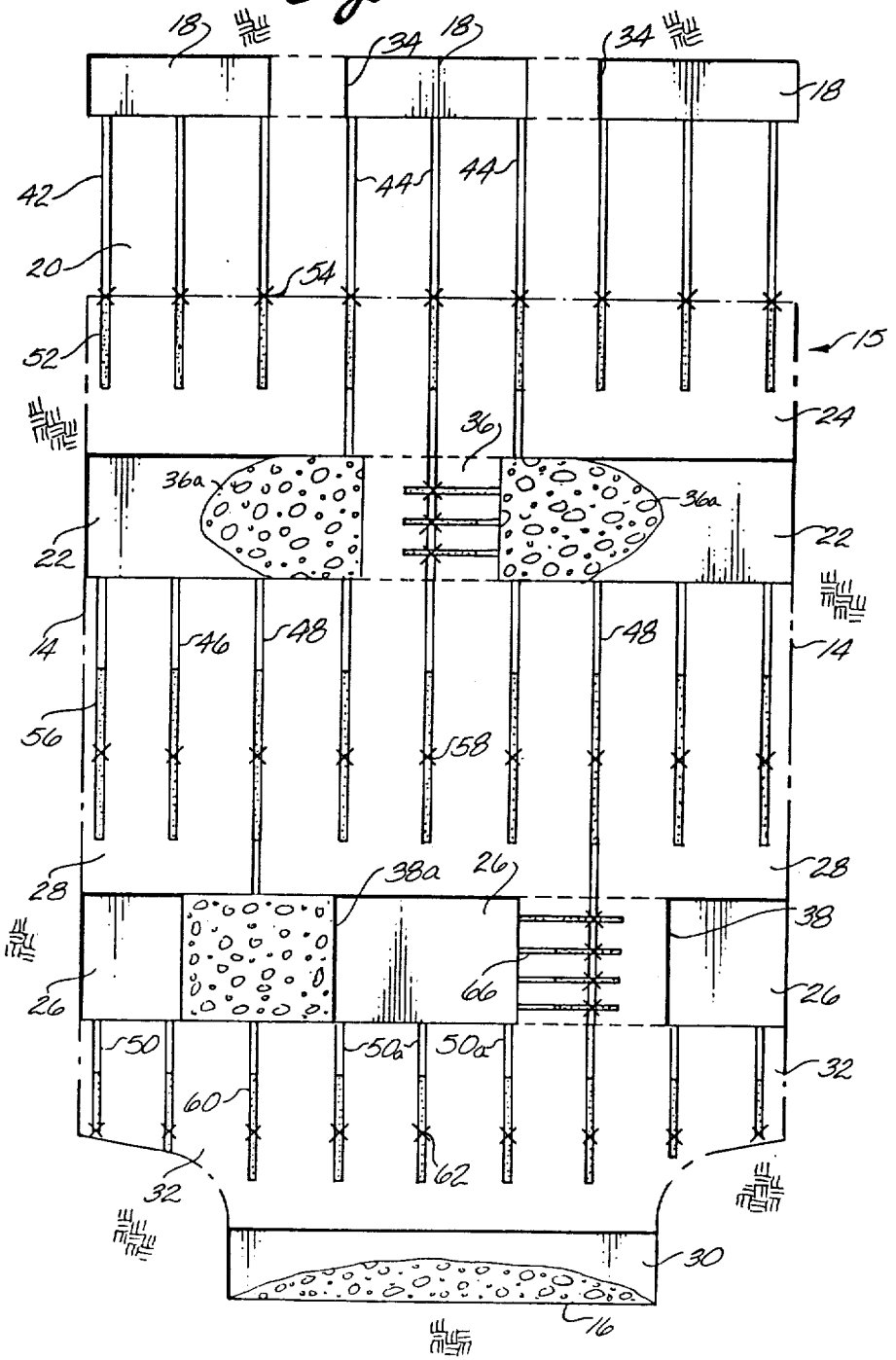
FIG. 5 is the same view as FIG. 2 at a later time interval.

FIG. 5 shows the subterranean formation of the exemplary sequence at a time of about 100 milliseconds where the pillar fragments **36*a* from the first explosive expansion in the outer rows of explosive in upper level pillar 36 are moving toward the side boundaries 14 of the retort being formed. It is preferred that the pillar fragments have a burden velocity of about 125 feet per second. In addition, at the time of about 100 milliseconds, the explosive charges in one of the intermediate level pillars 38 are center detonated, thereby explosively expanding such intermediate level pillar outwardly toward the void as indicated at 38*a***.

Figure 6:
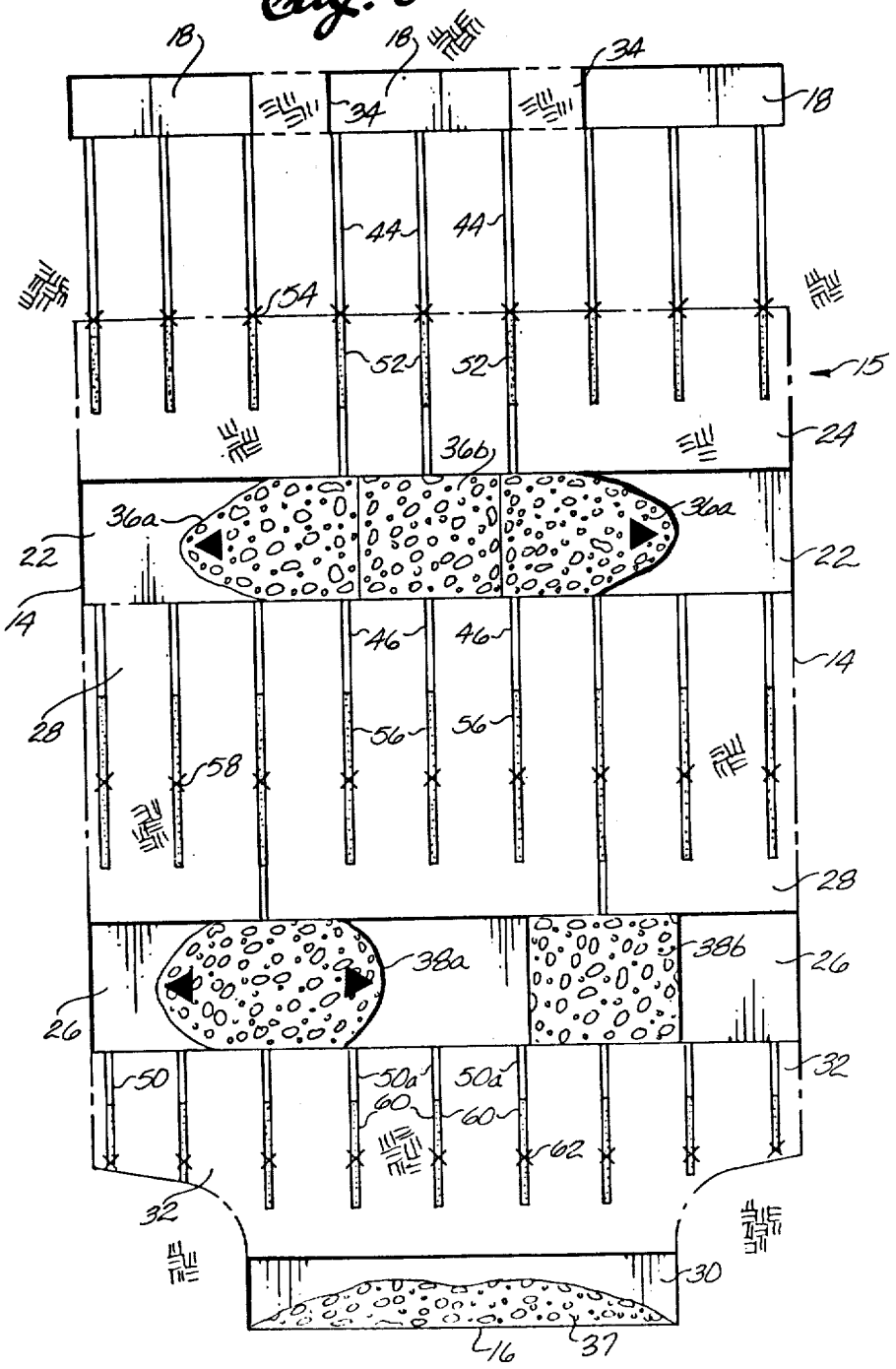
FIG. 6 is the same view as FIG. 2 at a still later time interval.

FIG. 6 shows the subterranean formation of the exemplary sequence at a time of about 125 milliseconds when explosive is detonated in the blastholes of the remaining intermediate level support pillar **38*b* for explosive expansion of said support pillar toward the void. In addition, detonation of explosive in the middle row in the upper level support pillar takes place at time 125 milliseconds for explosively expanding the remainder of the upper level support pillar toward the upper level void as indicated at 36*b***.

Figure 7:
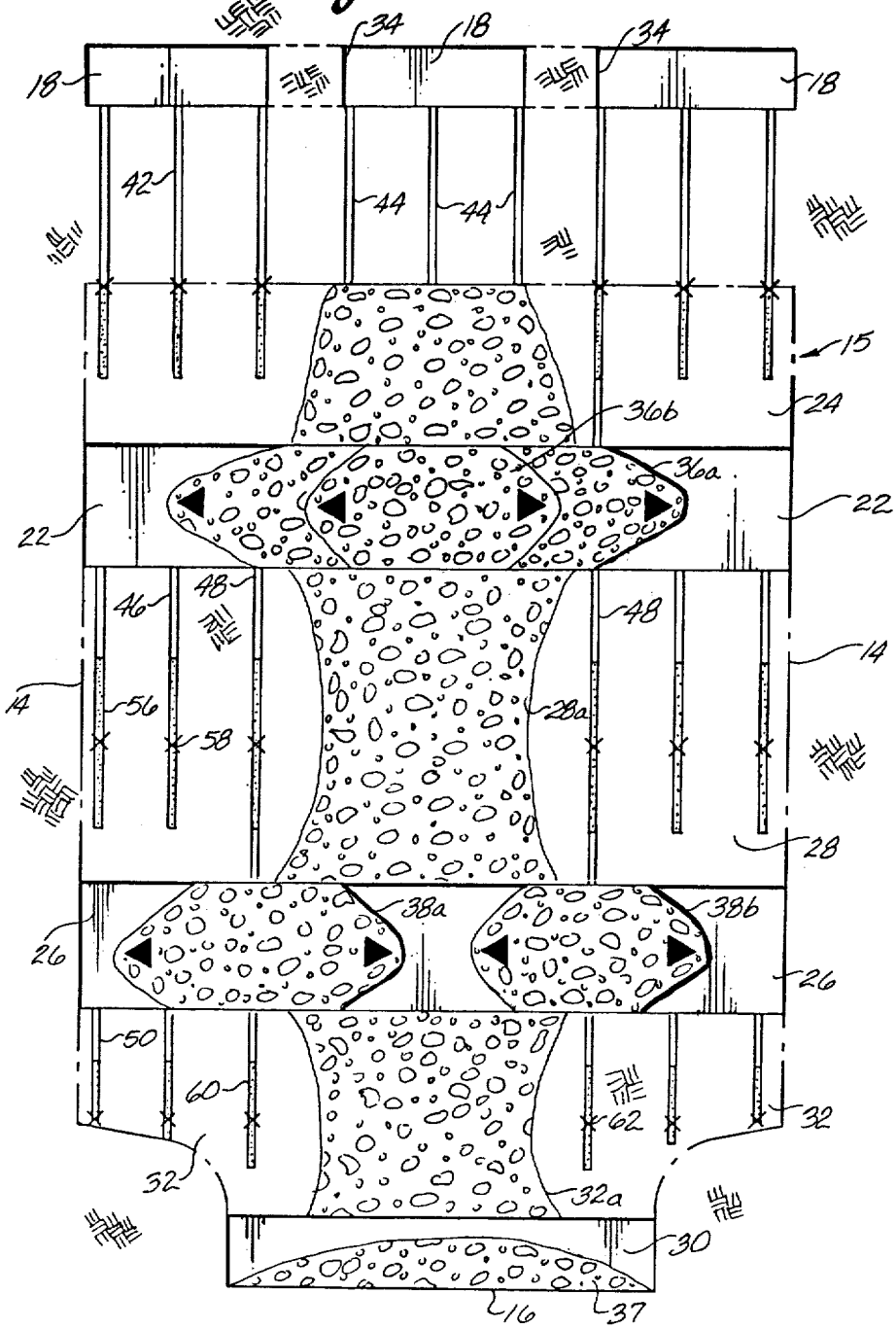
FIG. 7 is the same view as FIG. 2 at a still later time.

FIG. 7 is another view of the retort during explosive expansion at a time interval of about 225 milliseconds after time 0 of the exemplary sequence. FIG. 7 shows the pillar fragments **36*a* and 36*b* from the upper level pillar and pillar fragments 38*a* and 38*b* from both intermediate level pillars expanding towards the side boundaries 14 of the retort. In addition, FIG. 7** shows the results of the first detonation of explosive in the upper, intermediate, and lower zones of unfragmented formation for explosively expanding the zones of unfragmented formation toward the void.

In the example described, the explosive expansion takes place in the zones of unfragmented formation, both above and below each void. It can be desirable in other embodiments to explosively expand only the unfragmented formation above a void into the void or to explosively expand formation from below the void into such a void. The detonation of explosive charges in the zone below each void is at about the center of such a zone first. Thereafter, explosive charges are detonated in the zone below each void progressing generally radially outwardly from the first detonation. The detonation of explosives in the zone above each void is at about the center of such a zone first and thereafter explosive is detonated in the zone above each void progressing generally radially outwardly from the first detonation. The first detonation in the zone of unfragmented formation below each void and the first detonation of explosive in the zone of unfragmented formation above each void occurs substantially simultaneously. The rate of progression of detonations generally radially outwardly in the zone of unfragmented formation below the void and the rate of progression of detonations generally radially outwardly in the zone of unfragmented formation above the void is substantially equal.

In an exemplary sequence shown, the first detonation of explosive in each zone of unfragmented formation above and below each void is at about 225 milliseconds as shown in FIG. 7. The explosive charges 52 in the blastholes 44 of the upper zone of unfragmented formation, explosive charges 56 in the blastholes 44 of the intermediate zone of unfragmented formation and explosive charges 60 in the blastholes **50*a*** in the lower zone of unfragmented formation can be detonated at substantially the same time. Further, in the exemplary sequence shown, the first explosive expansion in the upper, intermediate, and lower zones of unfragmented formation is at about the locus of the center of mass of the support pillars adjacent each such zone of unfragmented formation.

It is preferred that the blast design is symmetrical in the zones both above and below each void. Therefore, discussion of the explosive expansion of a representative zone of unfragmented formation can be used to illustrate the explosive expansion of the upper, intermediate, and lower zones of unfragmented formation.

Figure 3:
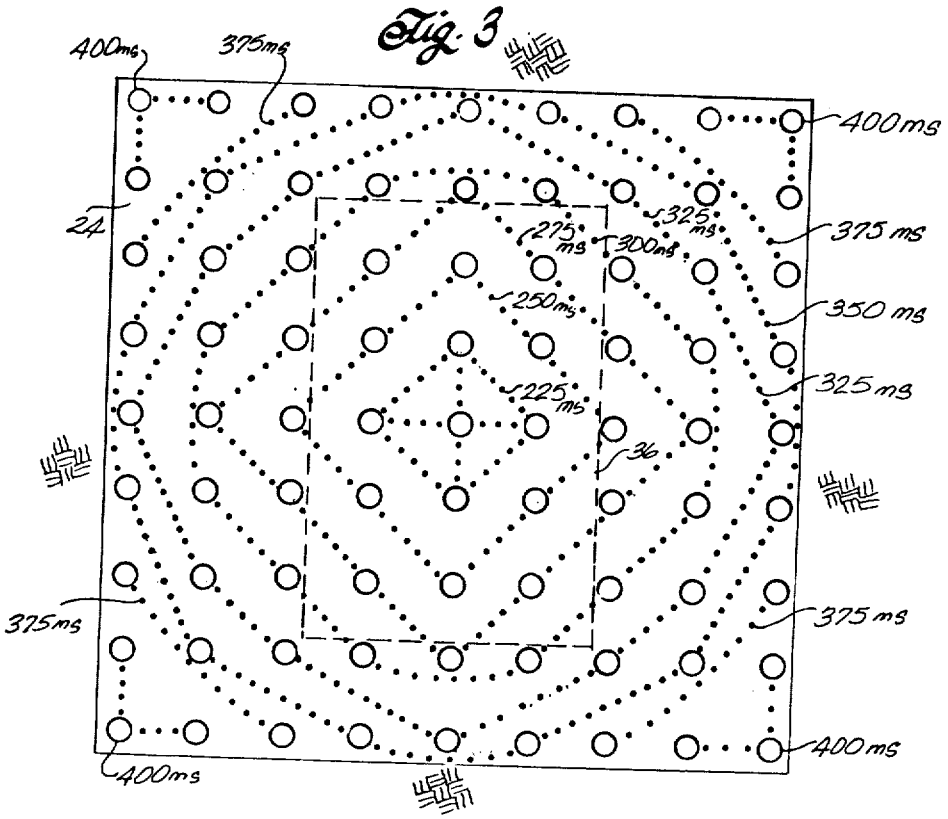
FIG. 3 is a plan view of the retort of FIG. 2.

An example, as shown in FIG. 3, is used to illustrate a preferred detonation sequence. FIG. 3 is a top view of the upper zone 24 of unfragmented formation with pillars in the overlying void deleted for clarity. The locus of the pillar 36 in the upper void beneath this zone 24 is indicated in dashed lines. A substantially square array of blastholes is drilled into such a zone. For example, as shown in FIG. 3, the substantially square array comprises 81 blastholes comprising nine rows of blastholes with nine blastholes in each row. The explosive in the blastholes which are shown connected by dotted lines is preferably detonated substantially simultaneously. The explosive can, therefore, be considered as being in bands of explosive charges, each band progressing substantially radially outwardly from about the center of the zone of unfragmented formation.

For example, the first explosive expansion in the upper zone 24 of unfragmented formation takes place wherein a first group of explosive charges in blastholes at the center of the unfragmented formation are detonated. In the example shown in FIG. 3, there are five explosive charges in the first group of explosive charges and these five explosive charges are detonated substantially simultaneously at a time of about 225 milliseconds as described hereinabove. This group is connected by dotted lines and identified as 225 ms in FIG. 3. Subsequently, a band of explosive charges, which substantially surrounds the first group of explosive charges 225 ms, is detonated. In the example shown in FIG. 3, at a time of about 250 milliseconds, a band of eight explosive charges 250 ms, which substantially surrounds the first group of explosive charges 225 ms, is detonated. Detonation progresses outwardly in bands until all explosive charges are detonated. It has been found desirable to use timing of about a 1 millisecond time delay for each foot of distance between adjacent blastholes in each band of blastholes. These numbers can be varied to reflect the availability of commercially available time delays with the required timing. For example, when 25 millisecond time delays are commercially available, then it can be desirable to use 25 millisecond time delays where the distance between adjacent blastholes in each band of blastholes is other than 25 feet. For example, it may be convenient to use the commercially available 25 millisecond time delays when the distance is 20 feet or 30 feet or the like.

As shown in the example of FIG. 3, at about 275 milliseconds, explosive is detonated in a surrounding band of blastholes 275 ms. The explosive expansion of the zone of unfragmented formation continues wherein a third band of explosive charges 300 ms substantially surrounds the second band 275 ms and is detonated at a time of about 300 milliseconds. Detonation progresses outwardly in bands at 25 millisecond intervals in successive bands 325 ms and 350 ms and groups of corner holes 375 ms and 400 ms.

As described hereinabove, the explosive expansion of each zone of unfragmented formation is preferred to be substantially symmetrical. That is, the explosive expansions in the intermediate and lower zones of unfragmented formation progress radially outwardly substantially identically to the progression outwardly of the explosive expansions illustrated in the upper zone of unfragmented formation.

Figure 8:
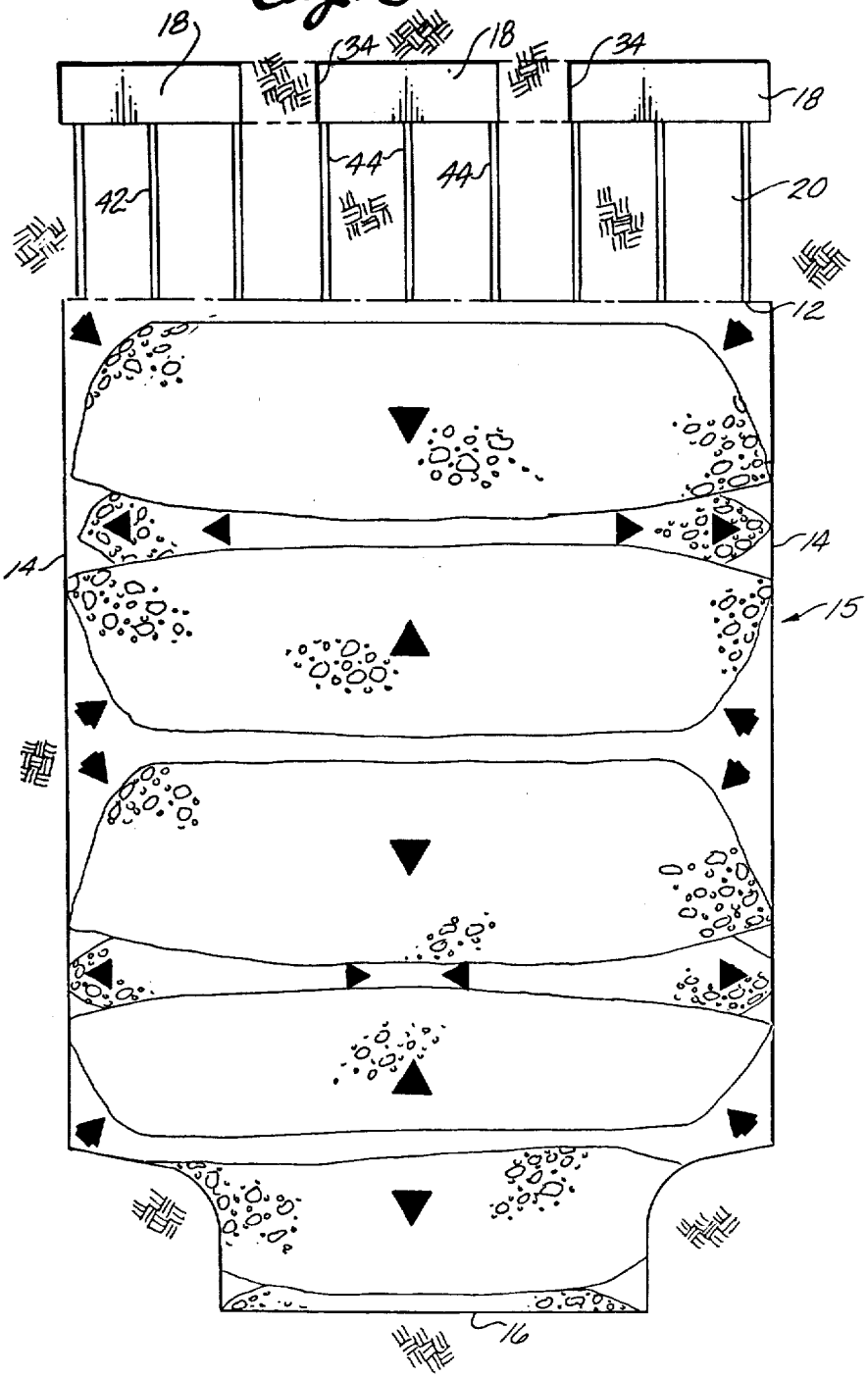
FIG. 8 is the same view as FIG. 2 at a still later time.

FIG. 8 shows the in situ oil shale retort at a time of about 425 milliseconds after time 0 in the exemplary sequence. At time 425 milliseconds, all explosive charges in the pillars and in each zone of unfragmented formation have been detonated. Thus, all of the formation in the retort site is explosively expanding. Many fragments from the pillars in the voids are near or at the side boundaries 14 of the retort being formed. The center portion of the zone of formation being expanded upwardly or downwardly toward the voids is more advanced than the edge portions since explosive charges near the center were detonated first. The expanding center portion therefore tends to "pinch" toward the pillar fragments while the outside portions have not yet advanced to the extent that they inhibit outward travel of fragments from the pillars. By closely following the blasting of the pillars with explosive expansion of the overlying and/or underlying formation, over-expansion of the pillars leading to a high void fraction band is inhibited. Somewhat later detonation of explosive in portions nearer the side boundaries of the retort permits continued flight of the pillar fragments toward the boundaries at the same time that over-expansion of the pillars in the region adjacent the locus of their center of mass is inhibited. Such relative timing promotes uniform distribution of void fraction in the fragmented mass in a retort.

Figure 9:
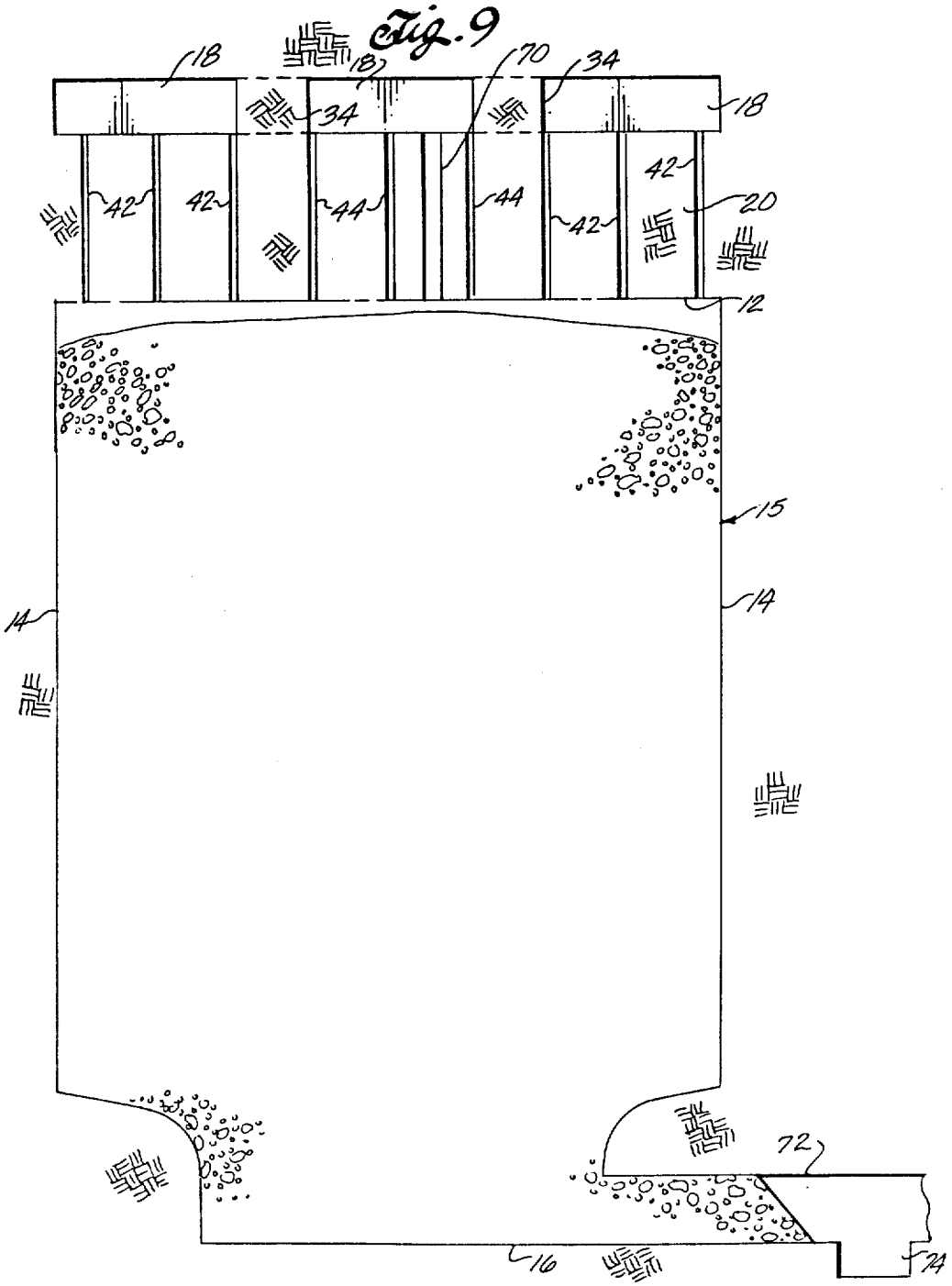
FIG. 9 is a fragmentary, semi-schematic vertical cross-sectional view of a completed in situ oil shale retort formed for operation according to principles of this invention.

In the exemplary sequence of FIG. 8, triangular arrows are superimposed on the expanding oil shale to indicate the direction of expansion and also to indicate the direction of explosive forces acting on the expanding formation. It is believed that there is some tendency for the formation adjacent the voids in regions near the side boundaries of the retort to expand toward the center portion of the retort and away from the side boundaries. A result of this tendency is indicated in FIG. 9 where the upper surface of the fragmented mass that forms in the retort upon explosive expansion is slightly mounded. That is, the upper surface is somewhat nearer the upper boundary of the retort near the center than it is near the edges.

To some extent, this tendency can be counteracted by increasing the time interval between the last detonation of explosive in the pillars and the first detonation of explosive in the zones of formation underlying and overlying such a void. This permits additional time for fragments from the pillars to approach the side boundaries of the retort before being stopped in flight by explosive expansion of formation from above or below the void. In the exemplary sequence hereinabove described and illustrated, a time interval of about 100 milliseconds elapsed between the last detonation in the pillars and the first detonation in the zones above and below the voids. Preferably, this interval is at least about 300 milliseconds to permit additional travel time for pillar fragments toward the side boundaries of the retort. This can permit a substantial portion of the pillar fragments to accumulate near the side boundaries of the retort and tends to minimize or counteract the tendency toward mounding.

The time interval between detonation of explosive in the pillars and detonation of explosive in the zones above and below the void should be long enough to permit a substantial portion of the pillar fragments to accumulate adjacent the side boundaries, taking into account the burden velocity of the fragments from the pillars and the burden velocity of the formation expanded upwardly and/or downwardly toward the void. In an embodiment where explosive expansion includes a portion expanding upwardly into the void, the interval should not be so long, however, that any substantial portion of the pillar fragments has come to rest on the floor of the void. Accumulation of substantial amounts of pillar fragments on the floor can inhibit such upward explosive expansion. Thus, the time interval between the last explosive detonation in the pillars and the first explosive detonation in the formation above or below the voids is sufficiently short that a substantial portion of the pillar fragments are still in flight approaching the side boundaries of the retort. The time interval can be minimized by loading substantial amounts of explosive in the pillars so that a relatively high burden velocity is obtained. In the embodiment hereinabove described and illustrated, the burden velocity of the formation explosively expanded upwardly and/or downwardly toward such a void is in the range of about 75 to 100 feet per second. The burden velocity of the pillar fragments is in the order of 125 feet per second. It is preferred not to reduce the burden velocity of upward and downward expansion appreciably below these values; the burden velocity of the pillars can, however, be increased. The values of the burden velocity of the pillar fragments and the burden velocity of the formation expanded upwardly or downwardly are important in combination with each other and in combination with the timing of the explosive expansion for providing pillar fragments dispersed as desired throughout the fragmented permeable mass being formed.

In the technique hereinabove described and illustrated, the formation located at about the center of a zone of unfragmented formation above and/or below a void is moved a greater distance in a given time interval after beginning of a round of explosions than formation located outward from at about the center by the relative timing of detonation of explosive charges in uniformly loaded blastholes.

Alternatively, such differential movement can be obtained by essentially simultaneous detonation of all explosive charges in such a zone of unfragmented formation with arrangement of explosive charges for giving a high burden velocity to expanding formation in the center portion, as compared with giving a low burden velocity to expanding formation nearer the side boundaries of the retort. To impart a high burden velocity to expanding formation of the center portion, for example, a more energetic explosive can be used in such center portion. The use of a more energetic explosive near such a center portion decreases the scaled depth of burial of explosive charges near this portion. Similarly, larger explosive charges or charges placed closer together near the center portion also tend to decrease the scaled depth of burial in the center portion.

The scaled point charge depth of burial as it applies to cratering and blasting to a horizontal free face is discussed in a paper by Bruce B. Redpath entitled "Application of Cratering Characteristics to Conventional Blast Design", a copy of which accompanies this application and is incorporated herein by this reference. The scaled depth of burial of an explosive charge can be expressed in units of distance over weight to the $\frac{1}{3}$ power or, preferably, in units of distance over energy of explosive to the $\frac{1}{3}$ power. The distance, which is referred to as burden distance in the equation per scaled depth of burial, is measured from the free face to the center of mass of the explosive charge where columnar explosive charges are used. The weight or energy in the equation is the total weight or energy for the column of explosive.

Thus, for example, if the scaled depth of burial is lower for the blastholes near the center of a zone of unfragmented formation, the energy of explosive in each column of explosive in that region is higher and, therefore, the burden velocity tends to be greater for formation near the center than for formation near the outer edges of the unfragmented formation. Accordingly, when all the charges in an array of explosive charges where the scaled depth of burial is lower near the center and higher radially outwardly from the center are detonated substantially simultaneously, the formation from at about the center of such an array will move a greater distance during a given time interval after the detonation than formation located outward from at about the center of the array.

Referring now to FIG. 9 of the exemplary embodiment, the in situ oil shale retort is shown after completion of detonation of all explosive charges and after fragmented formation has come to rest. The retort site now contains a fragmented permeable mass of formation particles containing oil shale. After forming the fragmented mass in the in situ oil shale retort as shown in FIG. 9, the final preparation steps for producing liquid and gaseous products from the retort are carried out. These steps, for example, include drilling at least one feed gas inlet passage 70 downwardly from the air level void 18 to the top boundary 12 of the retort so that oxygen supplying gas can be introduced into the fragmented permeable mass during retorting operations. Alternatively, at least a portion of the blastholes 42 and 44 through the sill pillar 20 can be used for introduction of the oxygen supplying gas. A substantially horizontal product withdrawal drift 72 extends away from a lower portion of the fragmented mass at the lower production level. The product withdrawal drift is used for removal of liquid and gaseous products of retorting.

During retorting operations, a combustion zone is established in an upper portion of the fragmented permeable mass and below the sill pillar 20 and the combustion zone is advanced downwardly through such fragmented mass by introduction of oxygen supplying gas into the retort. Combustion gas produced in the combustion zone passes through the fragmented mass to establish a retorting zone on the advancing side of the combustion zone wherein kerogen in the oil shale is retorted to produce liquid and gaseous products of retorting. The liquid products and an off gas containing gaseous products pass to the bottom of the fragmented mass and are withdrawn from the product withdrawal drift. A pump (not shown) is used to withdraw liquid products from a sump 74 to above ground. Off gas is withdrawn by a blower (not shown) and passed to above ground.

The above description of a method for recovering oil shale from a subterranean formation containing oil shale including the description of the explosive expansion of the zones of unfragmented formation containing oil shale is for illustrative purposes. Because of variations which will be apparent to those skilled in the art, the present invention is not intended to be limited to the particular embodiment described above. The scope of the invention is defined in the following claims.

What is claimed is:

1. A method of recovering shale oil from a subterranean formation containing oil shale which comprises the steps of:

excavating formation to form at least one void in the subterranean formation leaving zones of unfragmented formation above and below such a void, such a zone of unfragmented formation having a center and a substantially horizontal free face adjoining the void;

placing explosive into at least one of the zones of unfragmented formation;

forming a fragmented permeable mass of formation particles containing oil shale in an in situ oil shale retort in the subterranean formation by detonating such explosive for explosively expanding the unfragmented formation in such a zone of unfragmented formation in a single round for moving formation located at about the center of such zone of unfragmented formation a greater distance in a given time interval after beginning of the single round than formation located in such zone of unfragmented formation outward from about the center of such zone of unfragmented formation;

introducing gas into the fragmented permeable mass in the in situ oil shale retort for establishing a retorting zone in the fragmented permeable mass wherein oil shale is retorted to produce gaseous and liquid products, and for advancing the retorting zone through the fragmented permeable mass; and withdrawing the gaseous and liquid products from the in situ oil shale retort.

2. The method according to claim 1 comprising explosively expanding the unfragmented formation in such a zone of unfragmented formation by detonating explosive located at about the center of such zone of unfragmented formation, followed by detonations of explosive in such zone of unfragmented formation progressing generally radially outwardly from the center of such zone of unfragmented formation.

3. The method according to claim 1 comprising explosively expanding the zone of unfragmented formation below such a void and the zone of unfragmented formation above such a void toward the void comprising:

detonating explosive in the zone of unfragmented formation below the void at about the center of such zone of unfragmented formation first, thereafter detonating explosive in the zone of unfragmented formation below the void progressing generally radially outwardly from the first detonation in the zone of unfragmented formation below the void; and detonating explosive in the zone of unfragmented formation above the void at about the center of such zone of unfragmented formation first, thereafter detonating explosive in the zone of unfragmented formation above the void progressing generally radially outwardly from the first detonation in the zone of unfragmented formation above the void.

4. The method according to claim 3 wherein the first detonation in the zone of unfragmented formation below the void and the first detonation in the zone of unfragmented formation above the void occur substantially simultaneously, and the rate of progression of detonation generally radially outwardly in the zone of unfragmented formation below the void and the rate of progression of detonation generally radially outwardly in the zone of unfragmented formation above the void are substantially equal.

5. A method of recovering shale oil from a subterranean formation containing oil shale which comprises the steps of:

excavating formation to form at least one void in the subterranean formation leaving zones of unfragmented formation above and below such a void, such a zone of unfragmented formation having a center and a substantially horizontal free face adjoining the void, and leaving at least one support pillar in such a void meeting each adjacent zone of unfragmented formation at a juncture of such a support pillar and such a zone of unfragmented formation;

placing explosive into at least one of the zones of unfragmented formation;

placing explosive into such a pillar;

detonating explosive in the pillar and thereafter in a single round with detonation of explosive in the pillar, detonating explosive in such a zone of unfragmented formation adjacent the pillar for moving formation located at about the center of such zone of unfragmented formation a greater distance in a given time interval after the start of the single round than formation located in the zone of unfragmented formation outward from about the center of the zone of unfragmented formation, thereby forming a fragmented permeable mass of formation particles containing oil shale in an in situ oil shale retort in the subterranean formation;

introducing gas to the fragmented permeable mass in the in situ oil shale retort for establishing a retorting zone in the fragmented permeable mass wherein oil shale is retorted to produce gaseous and liquid products, and for advancing the retorting zone through the fragmented permeable mass; and withdrawing the gaseous and liquid products from the in situ oil shale retort.

6. The method according to claim 5 comprising explosively expanding the unfragmented formation in such a zone of unfragmented formation by detonating explosive located at about the center of such zone of unfragmented formation followed by detonation of explosive in the zone of unfragmented formation progressing generally radially outwardly from first detonation in such a zone of unfragmented formation.

7. The method according to claim 6 comprising explosively expanding the zone of unfragmented formation below such a void and the zone of unfragmented formation above such a void toward the void comprising:

detonating explosive in the zone of unfragmented formation below the void at about the center of such zone of unfragmented formation first, thereafter detonating explosive in the zone of unfragmented formation below the void progressing generally radially outwardly from the first detonation in the zone of unfragmented formation below the void; and detonating explosive in the zone of unfragmented formation above the void at about the center of such a zone of unfragmented formation first, thereafter detonating explosive in the zone of unfragmented formation above the void progressing generally radially outwardly from the first detonation in the zone of unfragmented formation above the void where the first detonation in the zone of unfragmented formation below the void and the first detonation in the zone of unfragmented formation above the void occur substantially simultaneously, and the rate of progression of detonation generally radially outwardly in the zone of unfragmented formation below the void and the rate of progression of detonation generally radially outwardly in the zone of unfragmented formation above the void are substantially equal.

8. The method according to claim 5 comprising detonating explosive in such zone of unfragmented formation for explosive expansion of such unfragmented formation with a sufficient time delay after explosive expansion of such pillar to distribute fragments of the pillar substantially uniformly across the void.

9. A method of recovering shale oil from a subterranean formation containing oil shale which comprises the steps of:

excavating formation to form at least one void in the subterranean formation leaving zones of unfragmented formation above and below such a void, such a zone of unfragmented formation having a center and a substantially horizontal free face adjoining the void, and leaving at least one support pillar in such a void meeting each adjacent zone of unfragmented formation at a juncture of such a support pillar and such a zone of unfragmented formation;

placing explosive into at least one of the zones of unfragmented formation;

placing explosive into such a pillar;

detonating explosive in the pillar and detonating explosive in such a zone of unfragmented formation such that formation located at about the center of such a zone of unfragmented formation is moved a greater distance in a given time interval after a first detonation of explosive than formation located in the unfragmented formation outward from about the center of such a zone of unfragmented formation, thereby forming a fragmented permeable mass of formation particles containing oil shale in an in situ oil shale retort in the subterranean formation;

introducing gas into the fragmented permeable mass in the in situ oil shale retort for establishing a retorting zone in the fragmented permeable mass wherein oil shale is retorted to produce gaseous and liquid products, and for advancing the retorting zone through the fragmented permeable mass; and withdrawing the gaseous and liquid products from the in situ oil shale retort.

10. The method according to claim 9 comprising explosively expanding the unfragmented formation in such a zone of unfragmented formation by detonating explosive located at about the center of such zone of unfragmented formation followed by detonation of explosive in the zone of unfragmented formation progressing generally radially outwardly from a first detonation in such zone of unfragmented formation.

11. The method according to claim 9 comprising explosively expanding the zone of unfragmented formation below such a void and the zone of unfragmented formation above such a void toward the void comprising:

detonating explosive in the zone of unfragmented formation below the void at about the center of such a zone of unfragmented formation first, thereafter detonating explosive in the zone of unfragmented formation below the void progressing generally radially outwardly from the first detonation in the zone of unfragmented formation below the void; and detonating explosive in the zone of unfragmented formation above the void at about the center of such a zone of unfragmented formation first, thereafter detonating explosive in the zone of unfragmented formation above the void progressing generally radially outwardly from the first detonation in the zone of unfragmented formation above the void where the first detonation in the zone of unfragmented formation below the void and the first detonation in the zone of unfragmented formation above the void occur substantially simultaneously, and the rate of progression of detonations generally radially outwardly in the zone of unfragmented formation below the void and the rate of progression of detonations generally radially outwardly in the zone of unfragmented formation above the void are substantially equal.

12. The method according to claim 9 comprising detonating explosive in such a zone of unfragmented formation for explosive expansion of such unfragmented formation with a sufficient time delay after explosive expansion of such a pillar to distribute fragments of the pillar substantially uniformly across the void.

13. A method for forming an in situ oil shale retort in a retort site within a subterranean formation containing oil shale, such an in situ oil shale retort containing a fragmented permeable mass of formation particles containing oil shale comprising the steps of:

excavating formation to form at least one void in the subterranean formation leaving zones of unfragmented formation above and below each void, each zone of unfragmented formation having a substantially horizontal free face adjoining the void, and leaving at least one support pillar of unfragmented formation in such a void;

placing explosive into at least one of the zones of unfragmented formation;

placing explosive into the pillar;

detonating explosive in the pillar and thereafter in a single round with detonation of explosive in the pillar, detonating explosive in such a zone of unfragmented formation for moving formation located in the zone of unfragmented formation substantially vertically spaced apart from about the locus of the center of mass of such a pillar a greater distance in a given time interval after the start of the round than formation located in the zone of unfragmented formation outward from about the locus of the center of mass of such a pillar, thereby forming a fragmented permeable mass of formation particles containing oil shale in an in situ oil shale retort in the subterranean formation.

14. The method according to claim 13 comprising explosively expanding at least one of the zones of unfragmented formation above and below such a void by a first detonation of explosive located in the zone of unfragmented formation substantially vertically spaced apart from the locus of the center of mass of such a pillar followed by detonation of explosive in the zone of unfragmented formation progressing generally radially outwardly from the first detonation.

15. The method according to claim 13 comprising:

detonating explosive in such a zone of unfragmented formation below the void at about the locus of the center of mass of such a pillar first, thereafter detonating explosive in such a zone below the void progressing generally radially outwardly from the first detonation in the zone of unfragmented formation below the void; and detonating explosive in such a zone of unfragmented formation above the void at about the locus of the center of mass of such a pillar first, thereafter detonating explosive in such a zone of unfragmented formation above the void progressing generally radially outwardly from the first detonation in the zone of unfragmented formation above the void, wherein the first detonation in the zone of unfragmented formation below the void and the first detonation in the zone of unfragmented formation above the void occur substantially simultaneously, and the rate of progression of detonations generally radially outwardly in the zone of unfragmented formation below the void and the rate of progression of detonations generally radially outwardly in the zone of unfragmented formation above the void are substantially equal.

16. The method according to claim 13 comprising detonating explosive in such zone of unfragmented formation for explosive expansion of such unfragmented formation with a sufficient time delay after explosive expansion of the pillar to distribute fragments of such pillar substantially uniformly across the void.

17. A method of forming an in situ oil shale retort in a subterranean formation containing oil shale, such an in situ oil shale retort containing a fragmented permeable mass of formation particles containing oil shale, which comprises the steps of:

excavating formation to form at least one void in the subterranean formation leaving zones of unfragmented formation above and below such a void, each zone of unfragmented formation having a substantially horizontal free face adjoining such a void, and leaving at least one support pillar of unfragmented formation in such a void;

placing explosive into at least one of the zones of unfragmented formation for explosively expanding such zone of unfragmented formation;

placing explosive into the pillar;

detonating explosive in the pillar and in such a zone of unfragmented formation in a single round wherein the first detonation of explosive is at about the center of the zone of unfragmented formation followed by detonation of explosive in the zone of unfragmented formation progressing generally radially outwardly from the first detonation, thereby forming a fragmented permeable mass of formation particles containing oil shale in an in situ oil shale retort in the subterranean formation.

18. The method according to claim 17 comprising explosively expanding the zone of unfragmented formation below such a void and the zone of unfragmented formation above such a void toward the void comprising:

detonating explosive in the zone of unfragmented formation below the void at about the center of such a zone of unfragmented formation first, thereafter detonating explosive in the zone of unfragmented formation below the void progressing generally radially outwardly from the first detonation in the zone of unfragmented formation below the void; and detonating explosive in the zone of unfragmented formation above the void at about the center of such a zone of unfragmented formation first, thereafter detonating explosive in the zone of unfragmented formation above the void progressing generally radially outwardly from the first detonation in the zone of unfragmented formation above the void, wherein the first detonation in the zone of unfragmented formation below the void and the first detonation in the zone of unfragmented formation above the void occur substantially simultaneously, and the rate of progression of detonations generally radially outwardly in the zone of unfragmented formation below the void and the rate of progression of detonations generally radially outwardly in the zone of unfragmented formation above the void are substantially equal.

19. The method according to claim 17 comprising detonating explosive in such a zone of unfragmented formation for explosive expansion of such zone of unfragmented formation with a sufficient time delay after explosive expansion of the pillar to spread fragments of such pillar substantially uniformly across the void.

20. The method according to claim 17 comprising detonating explosive in such a zone of unfragmented formation for providing a burden velocity of about 75 to about 100 feet per second and detonating explosive in the pillar for providing a burden velocity of pillar fragments of about 125 feet per second.

21. A method for forming an in situ oil shale retort in a retort site within a subterranean formation containing oil shale, such an in situ oil shale retort containing a fragmented permeable mass of formation particles containing oil shale comprising the steps of:

excavating formation to form at least one void in the subterranean formation leaving zones of unfragmented formation above and below each void, each zone of unfragmented formation having a substantially horizontal free face adjoining the void, and leaving at least one support pillar of unfragmented formation in the void, each such support pillar meeting each zone of unfragmented formation at a juncture of such a pillar and such a zone of unfragmented formation;

placing explosive into at least one of the zones of unfragmented formation for explosively expanding such zone of unfragmented formation;

placing explosive into the pillar;

detonating explosive in the pillar and in such a zone of unfragmented formation in a single round wherein the first detonation of explosive in the zone of unfragmented formation is substantially vertically spaced apart from at about the locus of the center of mass of such a pillar, thereafter followed by detonation of explosive in the zone of unfragmented formation progressing generally radially outwardly from the first detonation, thereby forming a fragmented permeable mass of formation particles containing oil shale in the subterranean formation forming an in situ oil shale retort.

22. The method according to claim 21 comprising explosively expanding the zone of unfragmented formation below such a void and the zone of unfragmented formation above such a void toward the void comprising:

detonating explosive in the zone of unfragmented formation below the void at about the locus of the center of mass of such a pillar first, thereafter detonating explosive in the zone of unfragmented formation below the void progressing generally radially outwardly from the first detonation in the zone of unfragmented formation below the void;

detonating explosive in the zone of unfragmented formation above the void at about the locus of the center of mass of such a pillar first, thereafter detonating explosive in the zone of unfragmented formation above the void progressing generally radially outwardly from the first detonation in the zone of unfragmented formation above the void, where the first detonation in the zone of unfragmented formation below the void and the first detonation in the zone of unfragmented formation above the void occur substantially simultaneously, and the rate of progression of detonations generally radially outwardly in the zone of unfragmented formation below the void and the rate of progression of detonations generally radially outwardly in the zone of unfragmented formation above the void are substantially equal.

23. The method according to claim 21 comprising detonating explosive in the pillar first, and thereafter detonating explosive in such a zone of unfragmented formation at about the locus of the center of mass of the pillar, after a time delay sufficient to allow formation of a free face at the juncture of such pillar and such a zone of unfragmented formation owing to explosive expansion of the pillar.

24. The method according to claim 21 comprising detonating explosive in such a zone of unfragmented formation for explosive expansion of such zone of unfragmented formation with a sufficient time delay after explosive expansion of the pillar to distribute the fragments of such pillar substantially uniformly across the void.

25. The method according to claim 21 comprising detonating explosive in such a zone of unfragmented formation above such a void and in such a zone of unfragmented formation below such void for providing a burden velocity of about 75 to about 100 feet per second and detonating explosive in the pillar for providing a burden velocity of pillar fragments of about 125 feet per second.

26. A method of recovering shale oil from a subterranean formation containing oil shale which comprises the steps of:

excavating formation to form at least one void in the subterranean formation leaving zones of unfragmented formation above and below each void, each zone of unfragmented formation having a substantially horizontal free face adjoining the void;

placing explosive into at least one of the zones of unfragmented formation for explosively expanding such a zone of unfragmented formation;

forming a fragmented permeable mass of formation particles containing oil shale in an in situ oil shale retort in the subterranean formation by explosively expanding at least one of the zones of unfragmented formation above and below such a void toward the void in a single round wherein the first explosive expansion is at about the center of the zone of unfragmented formation, thereafter followed by explosive expansion of unfragmented formation progressing outwardly from the center;

introducing gas to the fragmented permeable mass in the in situ oil shale retort for establishing a retorting zone in the fragmented permeable mass wherein oil shale is retorted to produce gaseous and liquid products, and for advancing the retorting zone through the fragmented mass; and withdrawing the gaseous and liquid products from the retort.

27. The method according to claim 26 comprising explosively expanding the zone of unfragmented formation below the void and the zone of unfragmented formation above the void toward the void comprising:

detonating explosive in the zone below the void at about the center of such a zone first, thereafter detonating explosive in the zone below the void progressing generally radially outwardly from the first detonation in the zone of unfragmented formation below the void; and detonating explosive in the zone above the void at about the center of such a zone first, thereafter detonating explosive in the zone above the void progressing generally radially outwardly from the first detonation in the zone of unfragmented formation above the void where the first detonation in the zone of unfragmented formation above the void and the first detonation in the zone of unfragmented formation below the void occur simultaneously, and the rate of progression of detonations generally radially outwardly in the zone of unfragmented formation below the void and the rate of progression of detonations generally radially outwardly in the zone of unfragmented formation above the void are substantially equal.

28. A method for forming an in situ oil shale retort in a retort site within a subterranean formation containing oil shale, such an in situ oil shale retort containing a fragmented permeable mass of formation particles containing oil shale comprising the steps of:

excavating formation to form at least one void in the subterranean formation leaving zones of unfragmented formation above and below each void, each zone of unfragmented formation having a substantially horizontal free face adjoining such a void, and leaving at least one support pillar of unfragmented formation in such a void, each such support pillar meeting each zone of unfragmented formation at a juncture of such a pillar and such a zone of unfragmented formation;

placing an array of explosive charges into at least one of the zones of unfragmented formation for explosively expanding such a zone of unfragmented formation;

placing explosive into the pillar;

detonating explosive in the pillar and thereafter detonating the explosive charges in such a zone of unfragmented formation in a single round wherein the first detonation of explosive charges is of a first group of explosive charges at about the center of the array of explosive charges, followed by detonation of explosive charges in at least a first band of explosive charges substantially surrounding the first group, thereby forming a fragmented permeable mass of formation particles containing oil shale in an in situ oil shale retort in the subterranean formation.

29. The method according to claim 28 comprising explosively expanding the zone of unfragmented formation below the void and the zone of unfragmented formation above the void toward the void comprising:

detonating explosive in the zone of unfragmented formation below the void at about the center of such a zone of unfragmented formation first, thereafter detonating explosive in the zone of unfragmented formation below the void progressing generally radially outwardly from the first detonation in the zone of unfragmented formation below the void; and detonating explosive in the zone of unfragmented formation above the void at about the center of such a zone of unfragmented formation first, thereafter detonating explosive in the zone of unfragmented formation above the void progressing generally radially outwardly from the first detonation in the zone of unfragmented formation above the void where the first detonation in the zone of unfragmented formation below the void and the first detonation in the zone of unfragmented formation above the void occur substantially simultaneously, and the rate of progression of detonations generally radially outwardly in the zone of unfragmented formation below the void and the rate of progression of detonations generally radially outwardly in the zone of unfragmented formation above the void are substantially equal.

30. The method according to claim 28 comprising detonating explosive in such a zone of unfragmented formation for explosive expansion of such unfragmented formation with a sufficient time delay after explosive expansion of the pillar to spread the fragments of such pillar substantially uniformly across the void.

31. A method of recovering shale oil from a subterranean formation containing oil shale which comprises the steps of:

excavating formation to form at least one void in the subterranean formation leaving zones of unfragmented formation above and below such a void, each such zone of unfragmented formation having a center;

placing an array of explosive charges into at least one of the zones of unfragmented formation;

detonating such an array of explosive charges for explosively expanding unfragmented formation in such a zone of unfragmented formation for forming a fragmented permeable mass of formation particles containing oil shale in an in situ oil shale retort in the subterranean formation wherein the explosive charges in the array are detonated in a sequence such that formation located at about the center of the zone of unfragmented formation is moved a greater distance in a given time interval after the beginning of the detonation sequence than formation located in the zone of unfragmented formation outward from about the center of the zone of unfragmented formation;

introducing gas into the fragmented permeable mass in the in situ oil shale retort for establishing a retorting zone in the fragmented permeable mass wherein oil shale is retorted to produce gaseous and liquid products, and for advancing the retorting zone through the fragmented permeable mass; and withdrawing the gaseous and liquid products from the in situ oil shale retort.

32. A method of recovering shale oil from a subterranean formation containing oil shale which comprises the steps of:

excavating formation to form at least one void in the subterranean formation leaving zones of unfragmented formation above and below such a void, each such zone of unfragmented formation having a center, and leaving at least one support pillar in such a void;

placing a plurality of explosive charges into at least one of the zones of unfragmented formation;

placing at least one explosive charge into such a pillar;

detonating such explosive charge in the pillar and thereafter detonating the explosive charges in such a zone of unfragmented formation adjacent the pillar such that formation located at about the center of the zone of unfragmented formation is moved a greater distance in a given time interval after the start of the detonation of such explosive charges than formation located in the zone of unfragmented formation outward from about the center of the zone of unfragmented formation, thereby forming a fragmented permeable mass of formation particles containing oil shale in the subterranean formation;

introducing gas to the fragmented permeable mass for establishing a retorting zone in the fragmented permeable mass wherein oil shale is retorted to produce gaseous and liquid products, and for advancing the retorting zone through the fragmented permeable mass; and withdrawing the gaseous and liquid products from the fragmented permeable mass.

33. A method for forming a fragmented permeable mass within a subterranean formation comprising the steps of:

excavating formation to form at least one void in the subterranean formation leaving zones of unfragmented formation immediately adjacent each such void having a substantially horizontal free face adjoining the void, and leaving at least one support pillar of unfragmented formation in such a void;

placing a plurality of explosive charges into at least one of the zones of unfragmented formation;

placing at least one explosive charge into the pillar; and detonating the explosive charges in the pillar and in such a zone of unfragmented formation in a sequence such that formation located in the zone of unfragmented formation substantially vertically spaced apart from about the locus of the center of mass of the pillar is moved a greater distance in a given time interval after the start of the detonation sequence than formation located in the zone of unfragmented formation horizontally spaced from about the locus of the center of mass of the pillar for forming a fragmented permeable mass of formation particles in the subterranean formation.

34. A method of forming a fragmented permeable mass of formation particles in a subterranean formation, which comprises the steps of:

excavating formation to form at least one void in the subterranean formation leaving zones of unfragmented formation above and below such a void, each zone of unfragmented formation having a substantially horizontal free face adjoining such a void;

placing a plurality of explosive charges into at least one of the zones of unfragmented formation for explosively expanding such zone of unfragmented formation; and detonating the explosive charges in the zone of unfragmented formation in a sequence progressing generally radially outwardly from the center of the zone of unfragmented formation thereby forming a fragmented permeable mass of formation particles in the subterranean formation.

35. A method for forming a fragmented mass of formation particles within a subterranean formation comprising the steps of:

excavating formation to form at least one void in the subterranean formation leaving zones of unfragmented formation above and below each void;

placing an array of explosive charges into at least one of the zones of unfragmented formation for explosively expanding such zone of unfragmented formation;

detonating the array of explosive charges in such a zone of unfragmented formation in a single round in a sequence wherein the first explosive charge detonated in the zone of unfragmented formation is substantially at the center of the zone of unfragmented formation and thereafter explosive charges are detonated progressing generally radially outwardly from the first detonation, thereby forming a fragmented permeable mass of formation particles in the subterranean formation.

36. A method of recovering shale oil from a subterranean formation containing oil shale which comprises the steps of:

excavating formation to form at least one void in the subterranean formation leaving zones of unfragmented formation above and below each void, each zone of unfragmented formation having a substantially horizontal free face adjoining the void;

placing a plurality of explosive charges into at least one of the zones of unfragmented formation for explosively expanding such a zone of unfragmented formation;

forming a fragmented permeable mass of formation particles containing oil shale in an in situ oil shale retort in the subterranean formation by detonating such explosive charges to thereby explosively expand such zone of unfragmented formation toward the void wherein the first explosive charge detonated is at about the center of the zone of unfragmented formation, thereafter followed by explosive expansion of unfragmented formation progressing outwardly from the center;

introducing gas to the fragmented permeable mass in the in situ oil shale retort for establishing a retorting zone in the fragmented permeable mass wherein oil shale is retorted to produce gaseous and liquid products, and for advancing the retorting zone through the fragmented mass; and withdrawing the gaseous and liquid products from the retort.

37. A method for forming an in situ oil shale retort in a retort site within a subterranean formation containing oil shale, such an in situ oil shale retort containing a fragmented permeable mass of formation particles containing oil shale comprising the steps of:

excavating formation to form at least one void in the subterranean formation, leaving a zone of unfragmented formation above such a void having a substantially horizontal free face adjoining the void;

placing a plurality of explosive charges into the zone of unfragmented formation for explosively expanding the zone of unfragmented formation; and detonating such explosive charges for forming a fragmented permeable mass of formation particles containing oil shale in the in situ oil shale retort by explosively expanding the zone of unfragmented formation above the void toward the void, wherein the first explosive expansion is at about the center of the zone of unfragmented formation, thereafter followed by explosive expansion of formation progressing outwardly from the center.

38. A method of recovering shale oil from a subterranean formation containing oil shale which comprises the steps of:

excavating formation to form at least one void in the subterranean formation leaving a zone of unfragmented formation above such a void, such a zone of unfragmented formation having a center and a substantially horizontal free face adjoining the void;

placing a plurality of explosive charges into the zone of unfragmented formation;

detonating such explosive charges in a time delay sequence for explosively expanding the zone of unfragmented formation and forming a fragmented permeable mass of formation particles containing oil shale in an in situ oil shale retort, the time delay sequence being sufficient for moving formation located at about the center of the zone of unfragmented formation a greater distance in a given time interval after beginning of the time delay sequence than formation located in the zone of unfragmented formation outward from about the center of the zone of unfragmented formation;

introducing gas into the fragmented permeable mass in the in situ oil shale retort for establishing a retorting zone in the fragmented permeable mass wherein oil shale is retorted to produce gaseous and liquid products, and for advancing the retorting zone through the fragmented permeable mass; and withdrawing the gaseous and liquid products from the in situ oil shale retort.

39. A method for forming an in situ oil shale retort in a retort site within a subterranean formation containing oil shale, such an in situ oil shale retort containing a fragmented permeable mass of formation particles containing oil shale comprising the steps of:

excavating formation to form at least one void in the subterranean formation, leaving a zone of unfragmented formation above such a void having a substantially horizontal free face adjoining the void;

placing a plurality of explosive charges into the zone of unfragmented formation for explosively expanding the zone of unfragmented formation; and detonating at least one such explosive charge at about the center of the zone of unfragmented formation, thereafter followed by detonation of a plurality of such explosive charges progressing outwardly from the center for explosively expanding the zone of unfragmented formation above the void toward the void for forming a fragmented permeable mass of formation particles containing oil shale in an in situ oil shale retort.

* * * * *